US006729079B2

(12) United States Patent
Francies, III et al.

(10) Patent No.: US 6,729,079 B2
(45) Date of Patent: May 4, 2004

(54) CONCRETE ANCHOR

(75) Inventors: Sidney E. Francies, III, Springboro, OH (US); Harry B. Lancelot, III, Centerville, OH (US)

(73) Assignee: Dayton Superior Corporation, Dayton, OH (US)

( * ) Notice: Subject to any disclaimer, the term of this patent is extended or adjusted under 35 U.S.C. 154(b) by 0 days.

(21) Appl. No.: 09/915,992

(22) Filed: Jul. 26, 2001

(65) Prior Publication Data

US 2003/0019169 A1 Jan. 30, 2003

(51) Int. Cl.[7] ..... E02D 35/00

(52) U.S. Cl. ..... 52/125.4; 52/125; 52/712; 52/125.5; 52/707; 52/155; 52/125.2; 52/125.3

(58) Field of Search ..... 52/125, 712, 125.5, 52/707, 155, 125.2, 125.3, 125.4

(56) References Cited

U.S. PATENT DOCUMENTS 4,173,856 A * 11/1979 Fricker ..... 52/125.5
4,329,826 A * 5/1982 Flogaus et al. ..... 52/712
4,627,198 A * 12/1986 Francies, III ..... 26452/125.5

* cited by examiner

*Primary Examiner*—Carl D. Friedman
*Assistant Examiner*—Steve Verner
(74) *Attorney, Agent, or Firm*—Wood, Herron & Evans, LLP; Thomas W. Flynn

(57) ABSTRACT

One preferred embodiment of an improved concrete anchor designed in accordance with the present invention for embedment in a concrete panel or the like includes an elongated bar having substantially flat parallel faces, an inner end disposed within the panel, an outer end disposed within a recess in the surface of the concrete panel and side edges extending between the faces. The side edges extend in continuously diverging relationship from adjacent the outer end to adjacent the inner end. In accordance with another embodiment, the preferred concrete anchor includes an elongated bar having substantially flat parallel faces; an inner end disposed within the panel; an outer end disposed within a recess in the surface of the concrete panel; and side edges, preferably substantially straight, which extend in a substantially parallel relationship between the faces. The outer end includes spaced, outwardly-projecting extensions disposed adjacent the side edges of the bar and, preferably, an elongated opening. The inner end is complementary in shape to the outer end, except that a major portion of the inner end is occupied by a void, preferably of triangular shape. The preferred concrete anchor is susceptible of relatively simple and economic manufacture as a unitary stamping.

18 Claims, 14 Drawing Sheets

CONCRETE ANCHOR

FIELD OF THE INVENTION

This invention relates to the field of static structures and, more specifically, to metallic structures anchored in prefabricated concrete panels or the like to facilitate lifting of such panels.

DESCRIPTION OF THE RELATED ART

Prefabricated concrete panels and the like are commonly used in construction. Very often, such panels are sufficiently heavy that mechanical means, such as cranes, must be used to move them. For this reason, it is known to embed metallic anchors in prefabricated concrete panels or the like to facilitate the grasping and lifting of such panels.

Many prior art concrete anchors used bent rods or the like to secure the anchors in the concrete panels. Examples of such structures include those disclosed in U.S. Pat. Nos. 3,456,547; 3,596,971; 4,018,470; and 4,179,151. One drawback to such structures is that they are difficult to manufacture, requiring the welding of separate rods to build up the desires structures.

Other prior art concrete anchors, such as those proposed in U.S. Pat. Nos. 3,883,170 and 4,173,856, were formed from stamped or die-cut metal. Each of the anchoring elements proposed in these patents were split longitudinally through inner ends thereof so as to form oppositely-bent anchoring legs to help secure the anchoring elements in the concrete. The splitting of the anchoring elements and bending of the anchoring legs would have added steps to the processes required to manufacture these anchoring elements, thereby raising the cost of the elements' manufacture.

Kelly U.S. Pat. No. 5,596,846; Kelly U.S. Design Pat. No. 392,752; and Kelly U.S. Design Pat. No. 389,251 proposed lifting anchors for embedment in concrete members. The lifting anchors comprised elongated bars having convergent and divergent surfaces wherein the divergent surfaces faced outwardly to direct axial pull-out forces imparted on the bars divergently and laterally into concrete members within which the anchors were embedded. The divergent surfaces terminated in enlarged feet formed at the proximal ends of the bars.

The lifting anchor proposed in Kelly U.S. Design Pat. No. 5,596,846 and of Kelly U.S. Design Pat. No. 389,251 also included a divergent wing extending laterally from an edge of the bar to transmit lateral lifting forces in outwardly divergent directions to a concrete member within which the bar was embedded. The addition of such a divergent wing would have required an additional welding step which would have increased the manufacturing cost of the lifting anchor.

Thus, there remains a need in the art for concrete anchors of relatively simple manufacture. There further remains a need in the art for combinations comprising such anchors embedded in concrete panels or the like sufficiently securely to resist pulling forces of magnitudes such as would be applied to the anchors while lifting or pivoting the panels.

SUMMARY OF THE INVENTION

These needs and others are addressed by an improved concrete anchor designed in accordance with the present invention for embedment in a concrete panel or the like, and by the structure formed by the combination of the concrete anchor with such a concrete panel. In accordance with a first embodiment, the preferred concrete anchor includes an elongated bar having substantially flat parallel faces, an inner end disposed within the panel, an outer end disposed within a recess in the surface of the concrete panel and side edges extending between the faces. The side edges extend in continuously diverging relationship from adjacent the outer end to adjacent the inner end.

The extension of the side edges in a continuously diverging relationship serves to firmly secure the concrete anchor in the concrete panel. More specifically, the configuration of the side edges of the preferred concrete anchor serves to direct the reaction forces generated by the application of a pulling force to the outer end of the elongated bar against the surrounding concrete of the concrete panel in a compressive mode. It is well known that concrete is strongest in compression. Thus, the extension of the side edges in a continuously diverging relationship serves to direct the reaction forces so as to maximize the ability of the surrounding concrete to sustain those reaction forces.

Preferably, the side edges of the preferred concrete anchor are substantially straight. Alternatively, the side edges include recesses defining recessed side edge sections in continuous diverging relationship.

The preferred concrete anchor further defines an elongated opening in its outer end and a void occupying a major portion of its inner end. Most preferably, the void is triangular or trapezoidal in shape so as to conform approximately to the continuously diverging relationship of the side edges. The void serves to further secure the concrete anchor in the concrete panel. When the concrete anchor is embedded in the concrete panel, as by casting the concrete panel over the concrete anchor, a "nugget" of concrete forms through the void. This nugget acts as a detent to directly resist pulling forces applied to the outer end of the elongated bar. The nugget also reinforces the side edges so as to promote the action of the side edges in directing the reaction forces generated by the application of a pulling force on the outer end against the surrounding concrete in a compressive mode.

In accordance with a second embodiment, the preferred concrete anchor includes an elongated bar having substantially flat parallel faces; an inner end disposed within the panel; an outer end disposed within a recess in the surface of the concrete panel; and side edges, preferably substantially straight, which extend in a substantially parallel relationship between the faces. The outer end includes spaced, outwardly-projecting extensions disposed adjacent the side edges of the bar and, preferably, an elongated opening. The inner end is complementary in shape to the outer end, except that a major portion of the inner end is occupied by a void, preferably of triangular shape. As previously mentioned, when the concrete anchor is embedded in the concrete panel, as by casting the concrete panel over the concrete anchor, the void interacts with the concrete material to retain the concrete anchor in the panel.

Most preferably, the concrete anchor is formed from a single metal stamping. This allows for a particularly simple method of manufacture as compared with prior art concrete anchors.

Therefore, it is one object of the invention to provide a novel concrete anchor of relatively simple construction which, in combination with a concrete panel or the like, forms a durable structure capable of being pivoted or lifted by engagement of a crane or other suitable means with the concrete anchor. These and other objects, features and advantages of the present invention will be described in further detail in connection with preferred embodiments of the invention shown in the accompanying drawings.

DETAILED DESCRIPTION

Figure 1:
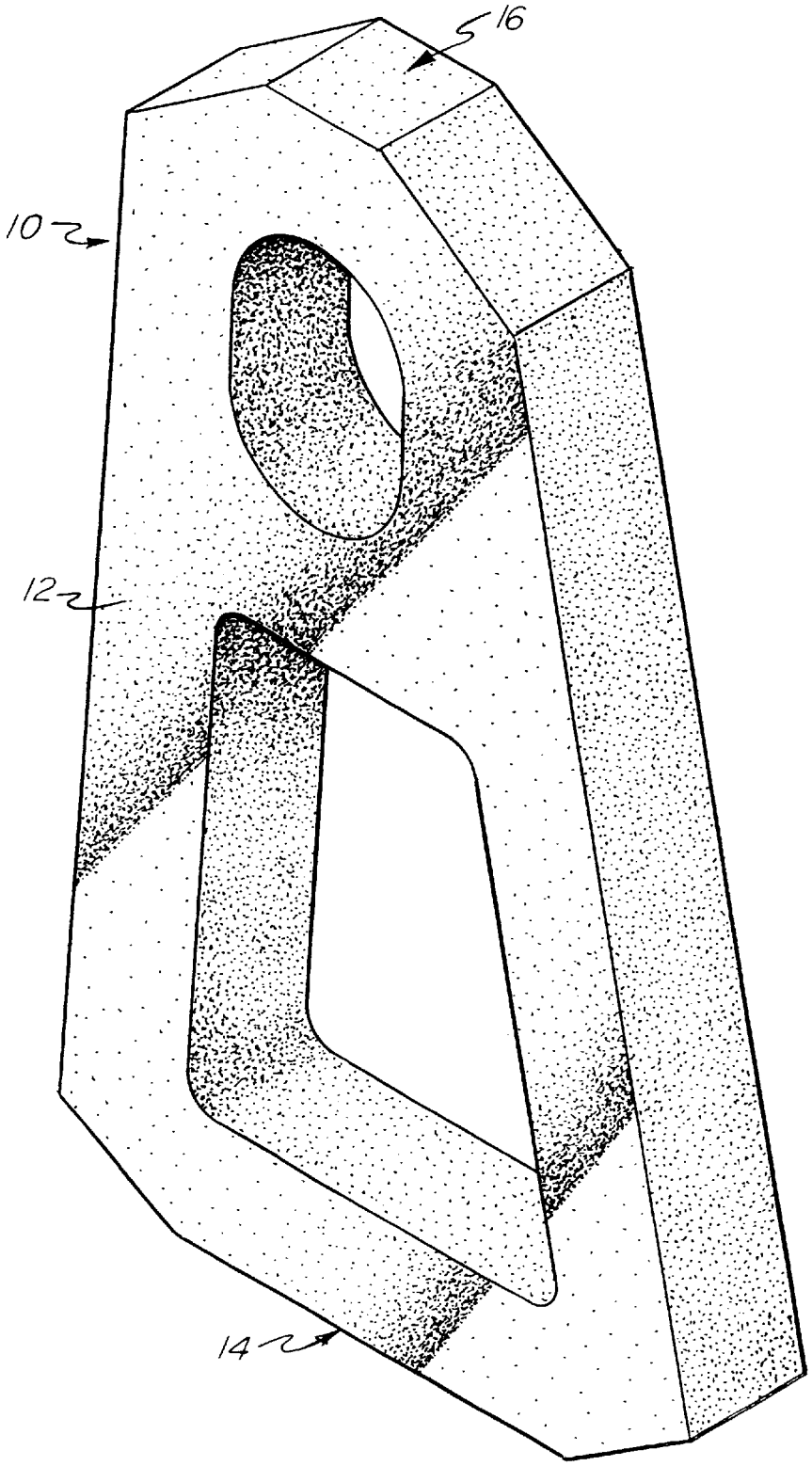
FIG. 1 is a perspective view of a first embodiment of a concrete anchor in accordance with the invention.
Figure 2:
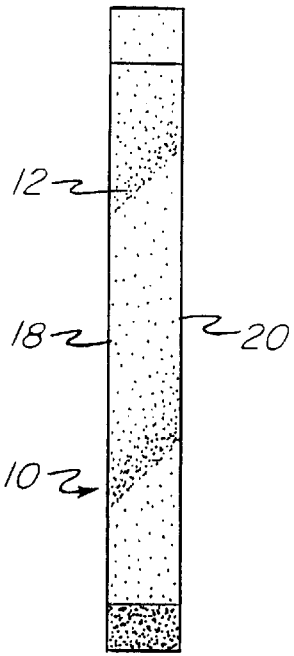
FIG. 2 is a side elevational view of the concrete anchor of FIG. 1, the opposite side elevational view being substantially identical.
Figure 3:
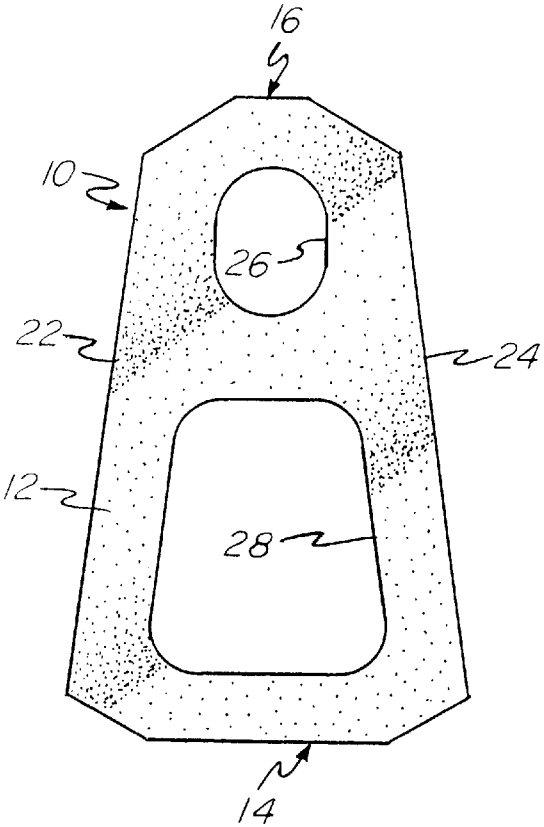
FIG. 3 is a front elevational view of the concrete anchor of FIG. 1, the rear elevational view being substantially identical.

As shown in FIG. 1, a first preferred embodiment of a concrete anchor 10 in accordance with the invention comprises an elongated metal bar 12. The elongated metal bar 12 defines an inner end 14 and an outer end 16. As shown in FIG. 2, the elongated metal bar 12 defines a first planar face 18 and a second planar face 20 parallel to the first planar face 18. As shown in FIG. 3, the elongated bar 12 further defines a first side edge 22 and a second side edge 24. Most preferably, the first and second side edges 22, 24 are substantially straight and extend in continuously diverging relationship from adjacent the outer end 16 to adjacent the inner end 14.

The elongated bar 12 of the preferred concrete anchor 10 further includes an elongated opening or eye 26 and a void 28. The elongated opening 26 and the void 28 each extend from the first planar face 18 through the elongated bar 12 to the second planar face 20. Most preferably, the void 28 occupies a major portion of the region of the elongated metal bar 12 near the inner end 14.

Figure 4:
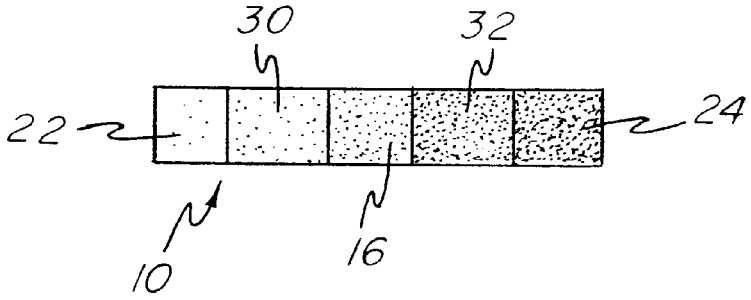
FIG. 4 is a top plan view of the concrete anchor of FIG. 1.
Figure 5:
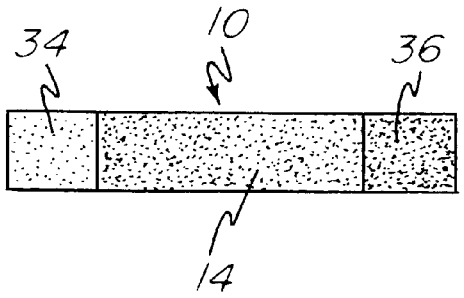
FIG. 5 is a bottom plan view of the concrete anchor of FIG. 1.

As shown in FIG. 4, the regions 30 and 32 where the first and second side edges 22, 24 approach the outer end 16 of the elongated bar 12 are chamferred. Similarly, as shown in FIG. 5, the regions 24 and 26 where the first and second side edges 22, 24 (FIGS. 2 and 4) approach the inner end 14 are chamferred.

Figure 6:
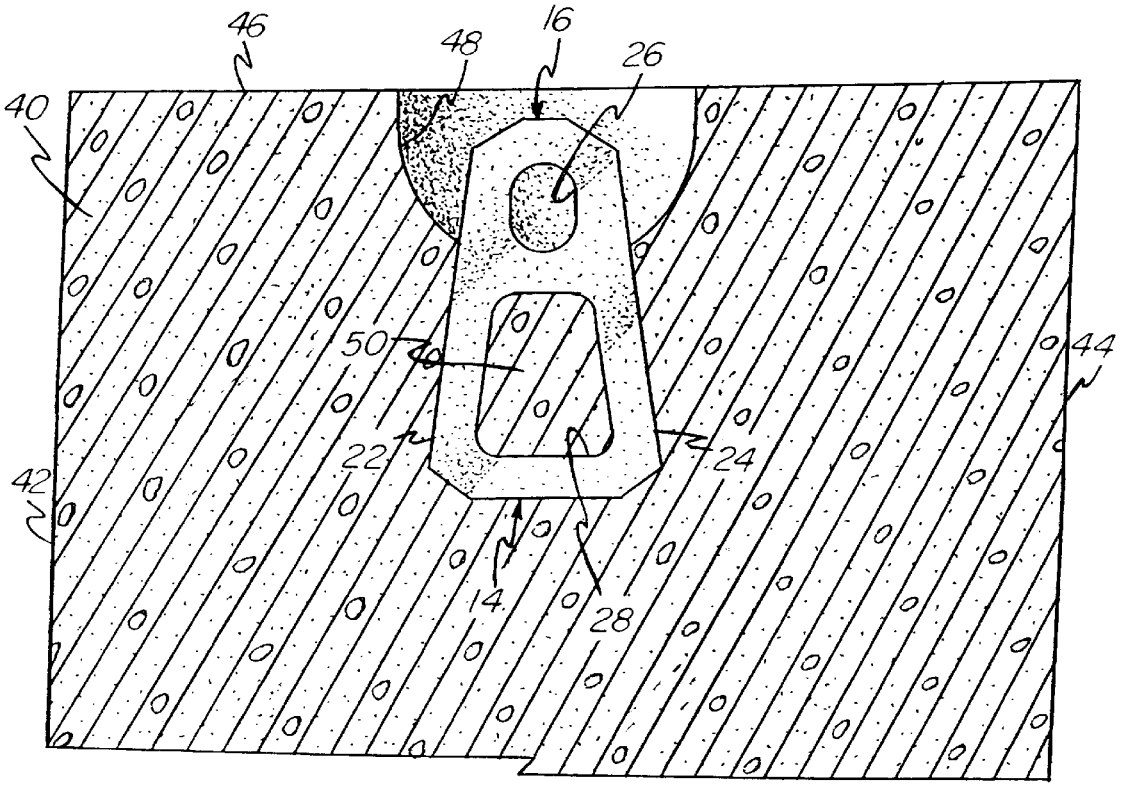
FIG. 6 is a partial sectional view of a concrete panel or the like with the concrete anchor of FIG. 1 embedded therein.

As shown in FIG. 6, the concrete anchor 10 preferably is combined with a concrete panel 40 or the like to provide means for lifting or pivoting the concrete panel 40. More specifically, the preferred concrete panel 40 defines a first major planar surface 42; a second major planar surface 44 parallel to the first major planar surface 42; a relatively narrow edge 46 extending between the first and second major planar surfaces 42, 44; and a recess 48 extending through the relatively narrow edge 46 into the concrete panel 40. The inner end 14 of the concrete anchor 10 preferably is embedded in the concrete panel 40. The outer end 16 of the concrete anchor 10 extends into the recess 48 for engagement by a crane (not shown) or the like.

Most preferably, the concrete anchor 10 is embedded in the concrete panel 40 by casting the concrete panel 40 around the concrete anchor 10. More specifically, it is preferred that the concrete panel 40 be cast in a form (not shown) with structure (not shown), of a type well known to those of ordinary skill in the art, for immobilizing the concrete anchor 10 and for forming the recess 48. As fluid casting material (not shown) is poured into the form (not shown), the material flows around the concrete anchor 10 and into the void 28 so as to form a "nugget" 50 extending through the void 28.

The structure of the concrete anchor 10 is designed to interact with the material of the concrete panel 40 to secure the concrete anchor 10 in the concrete panel 40. As noted earlier, it is well known that concrete has its greatest strength in compression. Since the side edges 22, 24 extend in continuously diverging relationship from adjacent the outer end 16 to adjacent the inner end 14, a pulling force applied to the outer end 16 of the concrete anchor 10 reacts against the material of the concrete panel 40 surrounding the concrete anchor 10 in a compressive mode. The nugget 50 acts as a detent to directly resist the pulling force applied to the outer end 16. Furthermore, the void 28 most preferably is triangular or trapezoidal in shape, conforming approximately to the continuously diverging relationship of the side edges 22, 24. The nugget 50 reinforces the side edges 22, 24 against deflection so as to promote the direction the reaction forces generated by the pulling force against the surrounding material of the concrete panel 40 in a compressive mode.

Figure 8:
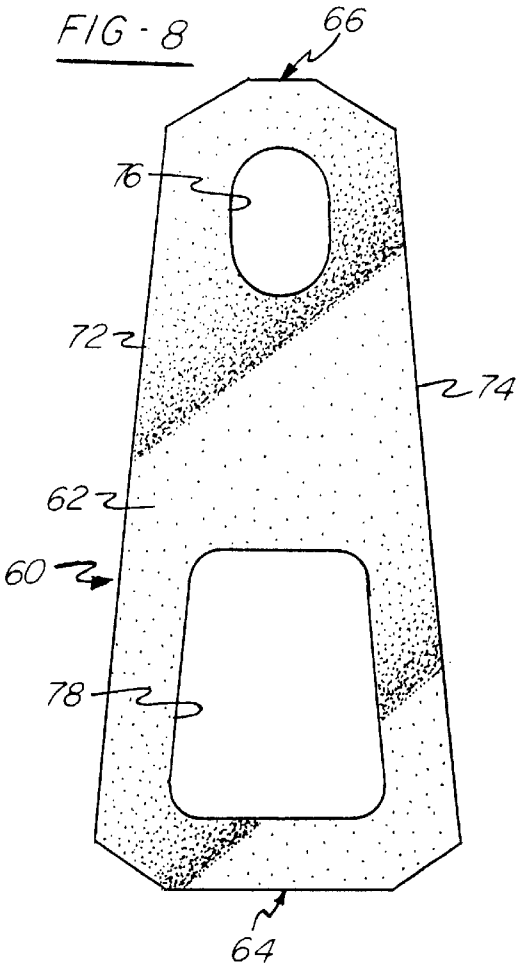
FIG. 8 is a front elevational view of the concrete anchor of FIG. 7, the rear elevational view being substantially identical.
Figure 7:
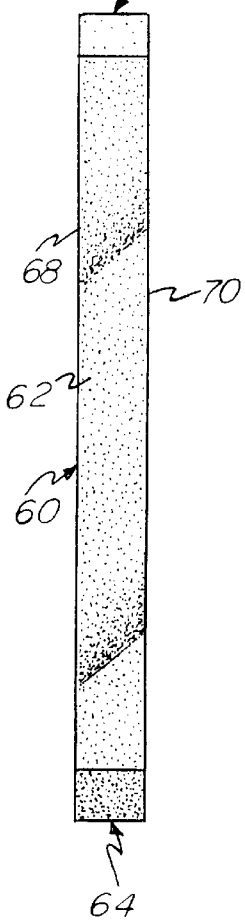
FIG. 7 is a side elevational view of a second embodiment of a concrete anchor in accordance with the invention, the opposite side elevational view being substantially identical.

As shown in FIG. 7, a second preferred embodiment of a concrete anchor 60 in accordance with the invention comprises an elongated metal bar 62 which defines an inner end 64 and an outer end 66. The elongated metal bar 62 also defines a first planar face 68 and a second planar face 70 parallel to the first planar face 68. As shown in FIG. 8, the elongated metal bar 62 further defines a substantially straight first side edge 72 and a substantially straight second side edge 74. The concrete anchor 60 further includes an elongated opening or eye 76 near the outer end 66 and a triangular or trapezoidal void 78 near the inner end 64.

Figure 10:
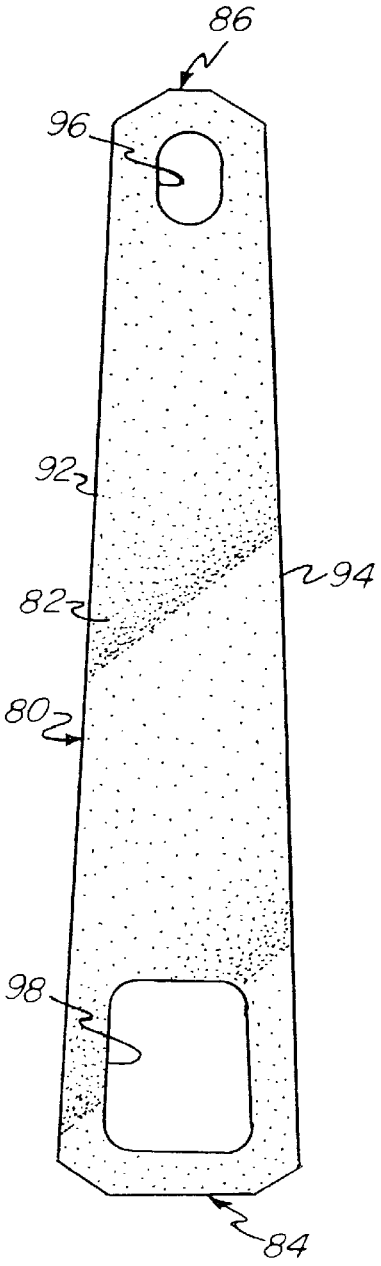
FIG. 10 is a front elevational view of the concrete anchor of FIG. 9, the rear elevational view being substantially identical.
Figure 9:
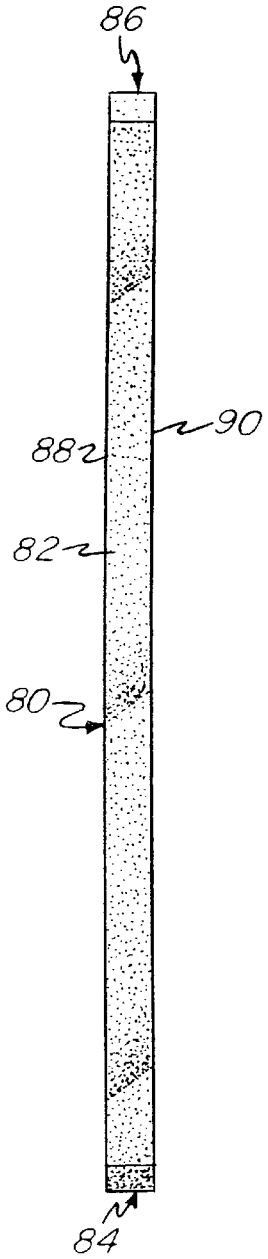
FIG. 9 is a side elevational view of a third embodiment of a concrete anchor in accordance with the invention, the opposite side elevational view being substantially identical.

As shown in FIG. 9, a third preferred embodiment of a concrete anchor 80 in accordance with the invention comprises an elongated metal bar 82 which defines an inner end 84 and an outer end 86. The elongated metal bar 82 also defines a first planar face 88 and a second planar face 90 parallel to the first planar face 88. As shown in FIG. 10, the elongated metal bar 82 further defines a substantially straight first side edge 92 and a substantially straight second side edge 94. The concrete anchor 80 further includes an elongated opening or eye 96 near the outer end 86 and a triangular or trapezoidal void 98 near the inner end 84.

Figure 12:
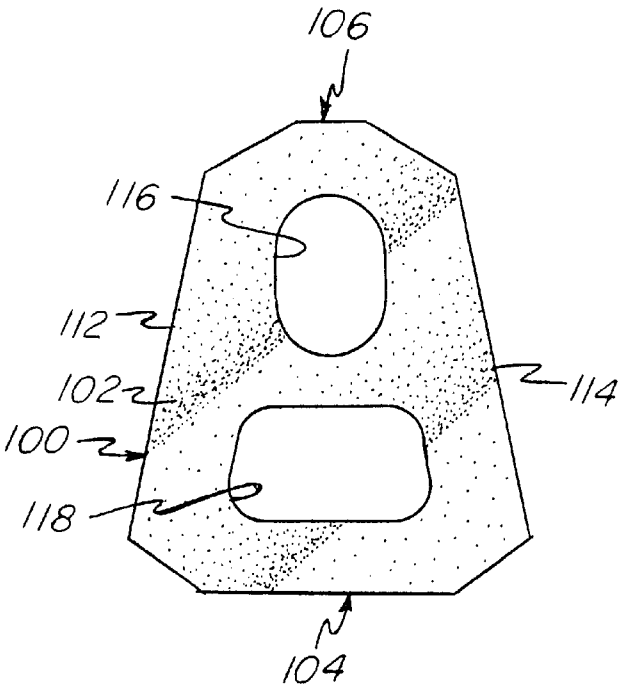
FIG. 12 is a front elevational view of the concrete anchor of FIG. 11, the rear elevational view being substantially identical.
Figure 11:
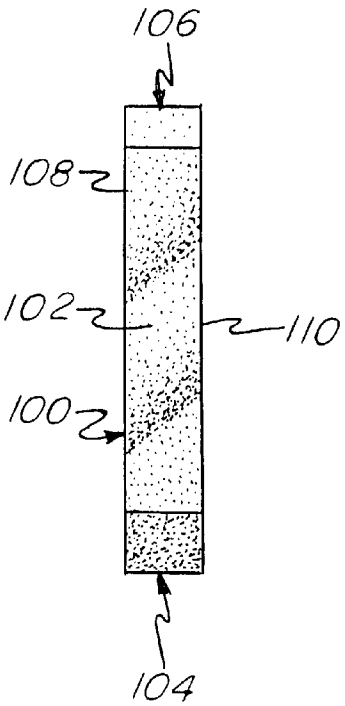
FIG. 11 is a side elevational view of a fourth embodiment of a concrete anchor in accordance with the invention, the opposite side elevational view being substantially identical.

As shown in FIG. 11, a fourth preferred embodiment of a concrete anchor 100 in accordance with the invention comprises an elongated metal bar 102 which defines an inner end 104 and an outer end 106. The elongated metal bar 102 also defines a first planar face 108 and a second planar face 110 parallel to the first planar face 108. As shown in FIG. 12, the elongated metal bar 102 further defines a substantially straight first side edge 112 and a substantially straight second side edge 114. The concrete anchor 100 further includes an elongated opening or eye 116 near the outer end 106 and a triangular or trapezoidal void 118 near the inner end 104.

In the second preferred embodiment 60 (FIGS. 7–8), the third preferred embodiment 80 (FIGS. 9–10) and the fourth preferred embodiment 100 (FIGS. 11–12), as in the first preferred embodiment 10 (FIGS. 1–5), the first and second side edges (72, 74 in FIG. 8; 92, 94 in FIG. 10; 112, 114 in FIG. 12) extend in continuously diverging relationship from adjacent the outer end (66 in FIG. 8; 86 in FIG. 10; 106 in FIG. 12) to adjacent the inner end 14 (64 in FIG. 8; 84 in FIG. 10; 104 in FIG. 12). The second, third and fourth embodiments 60 (FIGS. 7–8), 80 (FIGS. 9–10), 100 (FIGS. 11–12) combine with concrete panels (not shown) and perform therewith on the same principles as does the first preferred embodiment 10 (FIGS. 1–5). Indeed, the top and bottom plan views of the second, third and fourth preferred embodiments 60 (FIGS. 7–8), 80 (FIGS. 9–10) and 100 (FIGS. 11–12) are similar to the top and bottom plan views of the first preferred embodiment 10 in FIGS. 4 and 5, respectively.

As FIGS. 3, 8, 10 and 12 suggest, however, the side edges (22, 24 in FIG. 3; 72, 74 in FIG. 8; 92, 94 in FIG. 10; 112, 114 in FIG. 12) diverge at different rates or angles. In other words, the overall length of the concrete anchor 10 (FIGS. 1–5), 60 (FIGS. 7–8), 80 (FIGS. 9–10), 100 (FIGS. 11–12) relative to its width is not critical to the present invention. Most preferably, the side edges (22, 24 in FIG. 3; 72, 74 in FIG. 8; 92, 94 in FIG. 10; 112, 114 in FIG. 12) diverge at an included angle of approximately 3°–15° with respect to one another.

Figure 14:
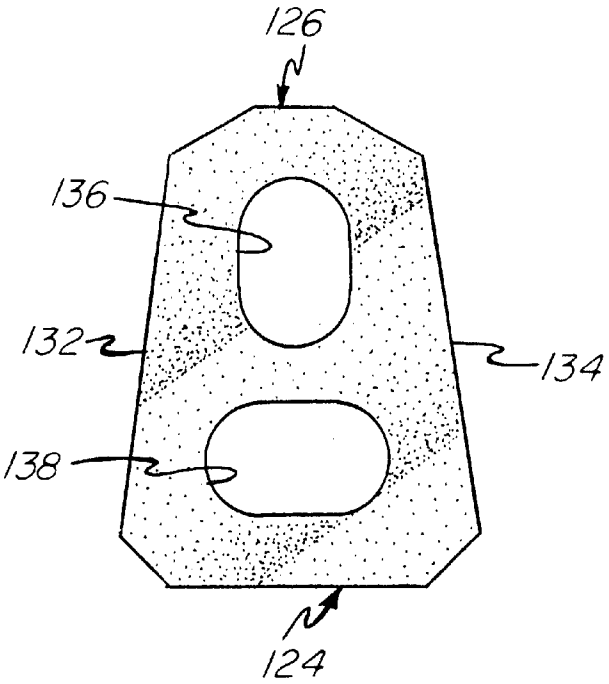
FIG. 14 is a front elevational view of the concrete anchor of FIG. 13, the rear elevational view being substantially identical.
Figure 13:
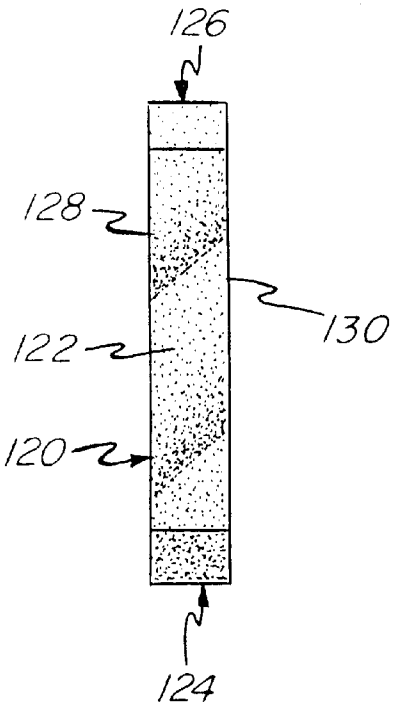
FIG. 13 is a side elevational view of a fifth embodiment of a concrete anchor in accordance with the invention, the opposite side elevational view being substantially identical.

As shown in FIG. 13, a fifth preferred embodiment of a concrete anchor 120 in accordance with the invention comprises an elongated metal bar 122 which defines an inner end 124 and an outer end 126. The elongated metal bar 122 also defines a first planar face 128 and a second planar face 130 parallel to the first planar face 128. As shown in FIG. 14, the elongated bar further defines a substantially straight first side edge 132 and a substantially straight second side edge 134. The concrete anchor 120 further includes an elongated opening or eye 136 near the outer end 126 and a void 138 near the inner end 124. The first and second side edges 132, 134 extend in continuously diverging relationship from adjacent the outer end 126 to adjacent the inner end 124.

Unlike the first, second, third and fourth preferred embodiments 10 (FIGS. 1–5), 60 (FIGS. 7–8), 80 (FIGS. 9–10) and 100 (FIGS. 11–12), however, the fifth preferred embodiment 120 has a void 138 in the shape of an elongated oval rather than triangular or trapezoidal. Although the shape of the void 138 of the fifth preferred embodiment 120 differs from the shapes of the voids (28 in FIG. 3; 78 in FIG. 8; 98 in FIG. 10; 118 in FIG. 12) of the earlier-disclosed preferred embodiments 10 (FIGS. 1–5), 60 (FIGS. 7–8), 80 (FIGS. 9–10) and 100 (FIGS. 11–12), it provides a sufficient opening to allow a "nugget" of material (not shown) to form when the concrete anchor 120 is embedded in a concrete panel (not shown). This nugget, in turn, would act as a detent to directly resist a pulling force applied to the outer end 126 of the concrete anchor 120. Furthermore, since the void 138 of the fifth preferred embodiment 120 occupies a major portion of the region of the elongated metal bar 122 near the inner end 124, the nugget (not shown) formed therethrough also would reinforce the side edges 132, 134 against deflection so as to promote the direction the reaction forces generated by the pulling force against the surrounding material of the concrete panel (not shown) in a compressive mode. In other words, while the void (28 in FIG. 3; 78 in FIG. 8; 98 in FIG. 10; 118 in FIG. 12; 138 in FIG. 14) most preferably takes a triangular or trapezoidal shape, the shape itself is not critical to the invention.

Figure 15:
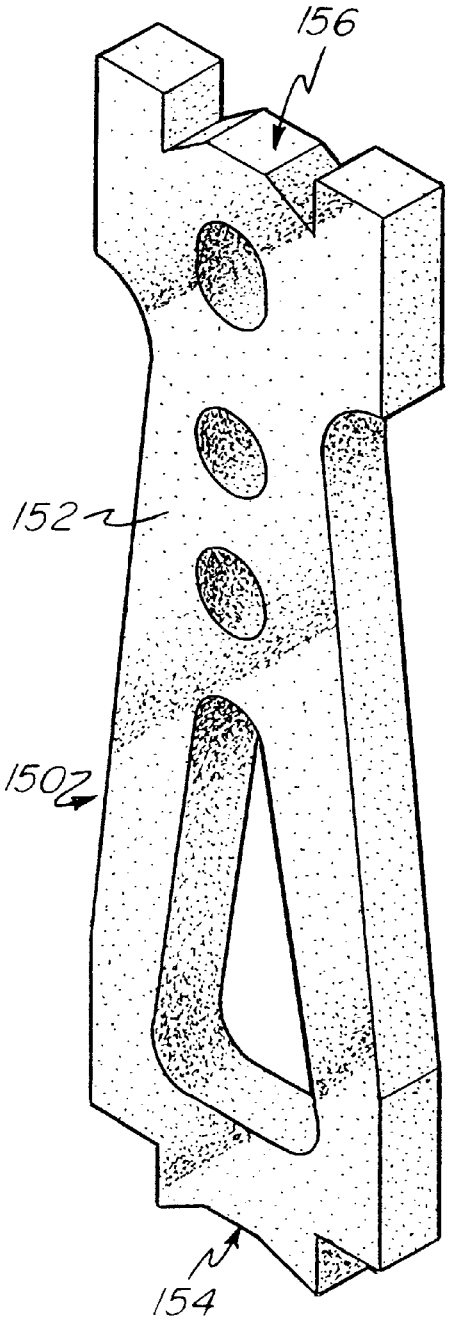
FIG. 15 is a perspective view of a sixth embodiment of a concrete anchor in accordance with the invention.
Figure 16:
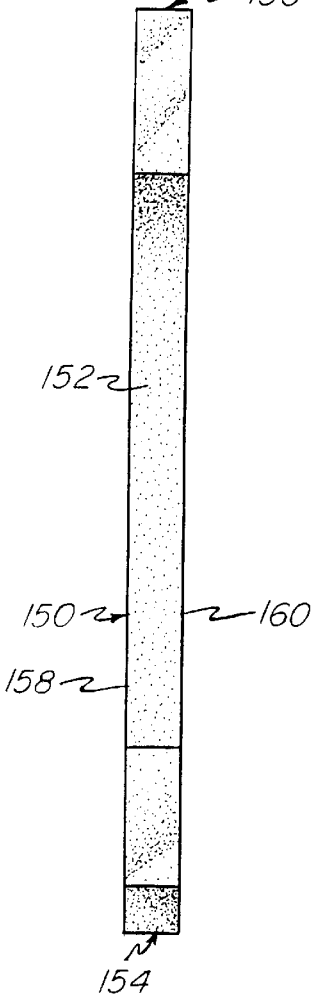
FIG. 16 is a side elevational view of the concrete anchor of FIG. 15, the opposite side elevational view being substantially identical.

As shown in FIG. 15, a sixth preferred embodiment of a concrete anchor 150 in accordance with the invention comprises an elongated metal bar 152. The elongated metal bar 152 defines an inner end 154 and an outer end 156. As shown in FIG. 16, the elongated metal bar 152 defines a first planar face 158 and a second planar face 160 parallel to the first planar face 158.

Figure 17:
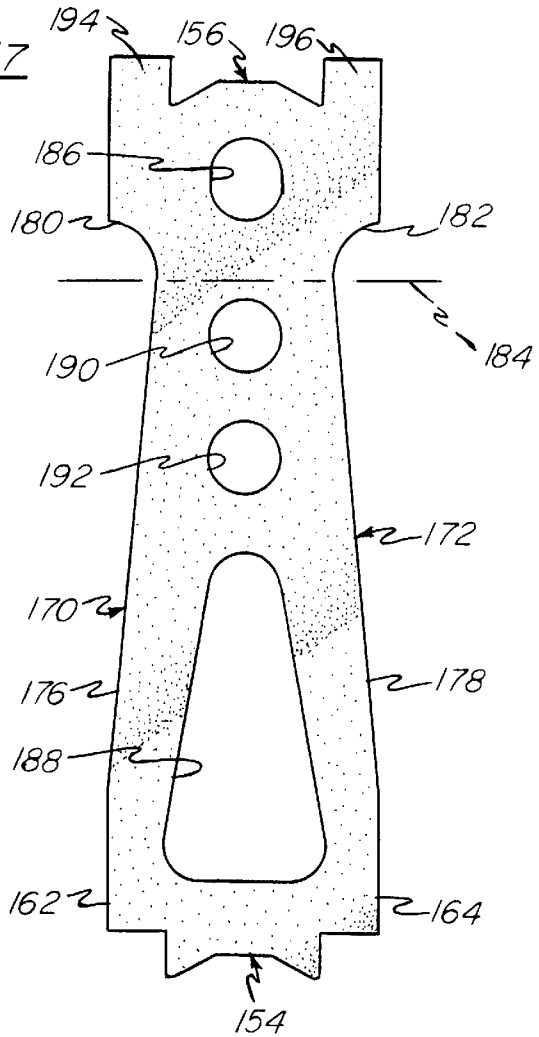
FIG. 17 is a front elevational view of the concrete anchor of FIG. 15, the rear elevational view being substantially identical.

As shown in FIG. 17, the elongated bar further defines a first inner side edge 162, a second inner side edge 164, a first outer side edge 166 and a second inner side edge 168. Most preferably, the first and second inner side edges 162, 164, and the first and second outer side edges 166, 168, are substantially parallel and straight. A pair of symmetrically-arranged recesses 170, 172 connect the first and second inner side edges 162, 164, respectively, with the first and second outer side edges 166, 168.

The recesses 170, 172 preferably define continuous, non-inflected profiles. Most preferably, the recesses 170, 172 define a first recess side edge 176 and a second recess side edge 178. The first and second recess side edges 176, 178 extend in diverging relationship from adjacent the outer end 156 to adjacent the inner end 154. Most preferably, the first and second recess side edges 176, 178 diverge at an included angle of approximately 3°–15° with respect to one another. The recesses 170, 172 also define concave cylindrical segments 180 and 182, each of which is joined continuously with a corresponding one of the first and second recess side edges 176, 178 along a plane 184 perpendicular to the extension of the first and second inner side edges 166, 168. Although preferred configurations for the recesses 170, 172 have been described, those preferred configurations are not critical to the invention and the selection of other suitable configurations are within the ordinary skill in the art.

The elongated bar 152 of the preferred concrete anchor 150 further includes an elongated opening or eye 186; a void 188; and holes 190 and 192. The elongated opening 186; the void 188; and the holes 190, 192 each extend from the first planar face 158 through the elongated bar 152 to the second planar face 160. Most preferably, the void 188 is triangular or trapezoidal and occupies a major portion of the region of the elongated metal bar 152 near the inner end 154.

Figure 18:
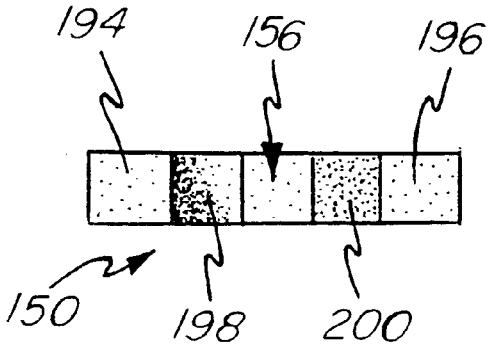
FIG. 18 is a top plan view of the concrete anchor of FIG. 15.
Figure 19:
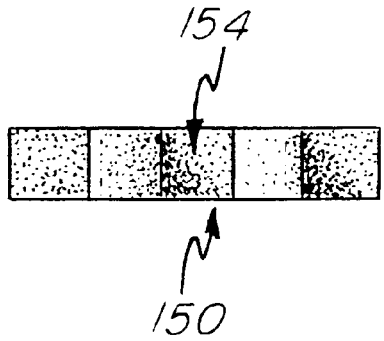
FIG. 19 is a bottom plan view of the concrete anchor of FIG. 15.

As shown in FIG. 18, the outer end 156 of the preferred concrete anchor 150 defines a pair of extensions 194 and 196 of the first and second outer side edges 166, 168 (FIG. 17). The outer end 156 is recessed and chamferred, as at 198 and 200 (FIG. 18), in the space between the extensions 194, 196. The inner end 154, shown in plan view in FIG. 19, is complementary in shape to the outer end 156.

Figure 20:
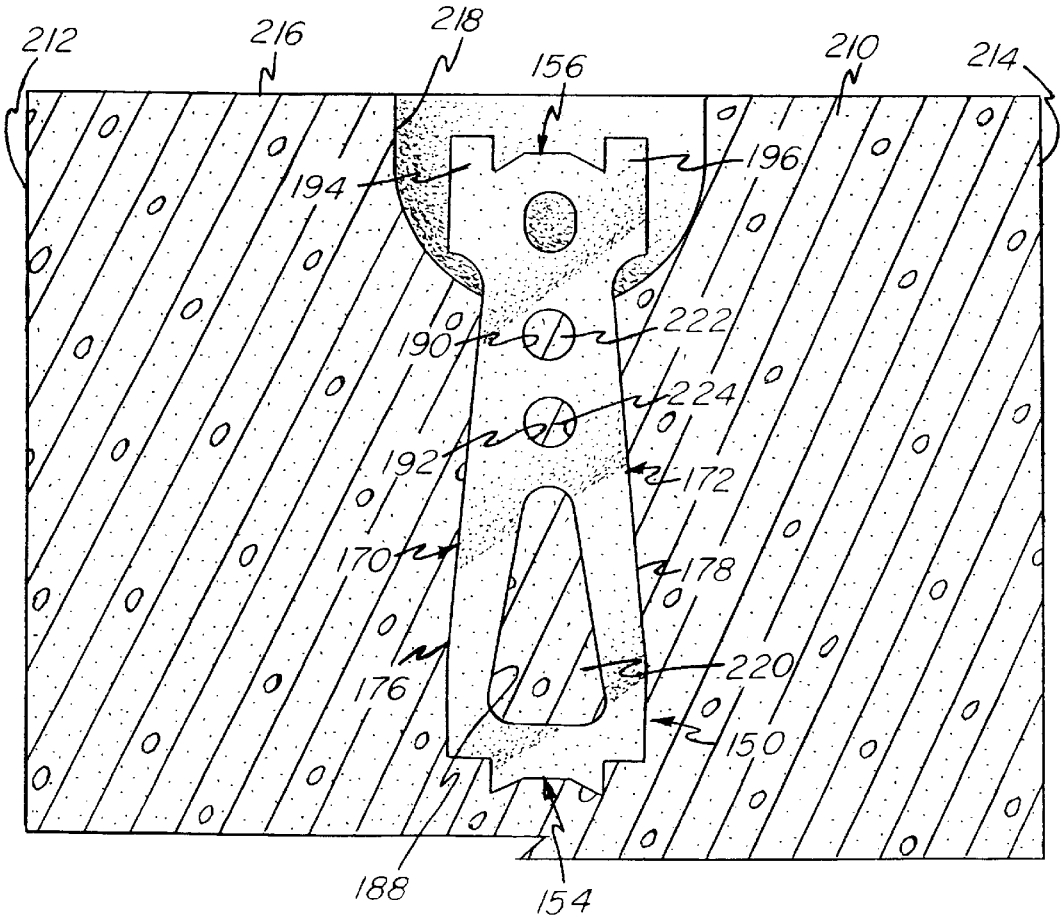
FIG. 20 is a partial sectional view of a concrete panel or the like with the concrete anchor of FIG. 15 embedded therein.

As shown in FIG. 20, the concrete anchor 150 preferably is combined with a concrete panel 210 or the like to provide means for lifting or pivoting the concrete panel 210. More specifically, the preferred concrete panel 210 defines a first major planar surface 212; a second major planar surface 214 parallel to the first major planar surface 212; a relatively narrow edge 216 extending between the first and second major planar surfaces 212, 214; and a recess 218 extending through the relatively narrow edge 216 into the concrete panel 210. The inner end 154 of the concrete anchor 150 preferably is embedded in the concrete panel 210. The outer end 156 of the concrete anchor 150 extends into the recess 218 for engagement by a crane (not shown) or the like.

As discussed in connection with the earlier-disclosed preferred embodiments 10 (FIGS. 1–5), 60 (FIGS. 7–8), 80 (FIGS. 9–10), 100 (FIGS. 11–12) and 120 (FIGS. 13–14), the concrete anchor 150 most preferably is embedded in the concrete panel 210 by casting the concrete panel 210 around the concrete anchor 150. More specifically, it is preferred that the concrete panel 210 be cast in a form (not shown) with structure (not shown), of a type well known to those of ordinary skill in the art, for immobilizing the concrete anchor 150 and for forming the recess 218. As fluid casting material (not shown) is poured into the form (not shown), the material flows around the concrete anchor 10 and into the void 188 and the two holes 190, 192 so as to form "nuggets" 220, 222 and 224 extending through the void 188 and the holes 190, 192.

The structure of the concrete anchor 150 is designed to interact with the material of the concrete panel 210 to secure the concrete anchor 150 in the concrete panel 210. Since the sections 176, 178 of the recesses 170, 172 extend in continuously diverging relationship along a direction parallel to that extending from adjacent to the outer end 156 to adjacent to the inner end 158, a pulling force applied to the outer end 156 of the concrete anchor 150 reacts against the material of the concrete panel 210 surrounding the concrete anchor 150 in a compressive mode. The nuggets 220, 222, 224 act as detents to directly resist the pulling force applied to the outer end 156. The nugget 220 also reinforces the sections 176, 178 of the recesses 170, 172 against deflection so as to promote the direction the reaction forces generated by the pulling force against the surrounding material of the concrete panel 210 in a compressive mode.

It is anticipated that such a pulling force will be exerted by a hook, grapple or the like (not shown) engaging the elongated opening. The extensions 194, 196 serve to protect the material surrounding the recess 214 from spalling as a result of repeated contact with such hooks, grapples or the like (not shown) during lifting or pivoting of the concrete panel 210.

Figure 21:
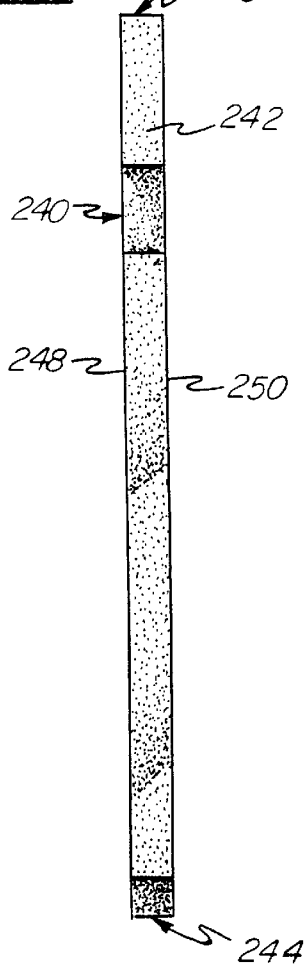
FIG. 21 is a side elevational view of a seventh embodiment of a concrete anchor in accordance with the invention, the opposite side elevational view being substantially identical.
Figure 22:
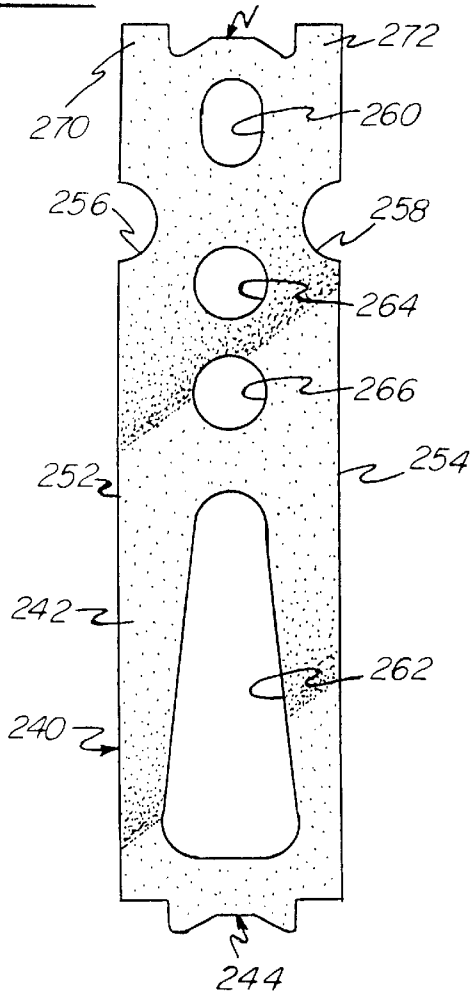
FIG. 22 is a front elevational view of the concrete anchor of FIG. 21, the rear elevational view being substantially identical.

As shown in FIG. 21, a seventh preferred embodiment of a concrete anchor 240 in accordance with the invention comprises an elongated metal bar 242 which defines an inner end 244 and an outer end 246. The elongated metal bar 242 also defines a first planar face 248 and a second planar face 250 parallel to the first planar face 248. As shown in FIG. 22, the elongated bar further defines a first side edge 252 and a second side edge 254. Most preferably, the first and second side edges 252, 254 are substantially straight and parallel. The concrete anchor 240 further includes a pair of semi-circular recesses 256 and 258 extending through the first and second side edges 252, 254 into the elongated metal bar 242.

The elongated bar 242 of the preferred concrete anchor 240 further includes an elongated opening or eye 260; a void 262; and holes 264 and 266, each of which extend from the first planar face 248 through the elongated bar 242 to the second planar face 250.

The outer end 246 of the preferred concrete anchor 240 is similar to the outer end 156 (FIGS. 17 and 18) of the sixth preferred embodiment 150 (FIGS. 15–19), defining a pair of extensions 270 and 272. The configuration of the inner end 244 is complementary to that of the outer end 246. The top and bottom plan views of the seventh preferred embodiment 240 are similar to the top and bottom plan views of the first preferred embodiment 150 in FIGS. 18 and 19.

Figure 23:
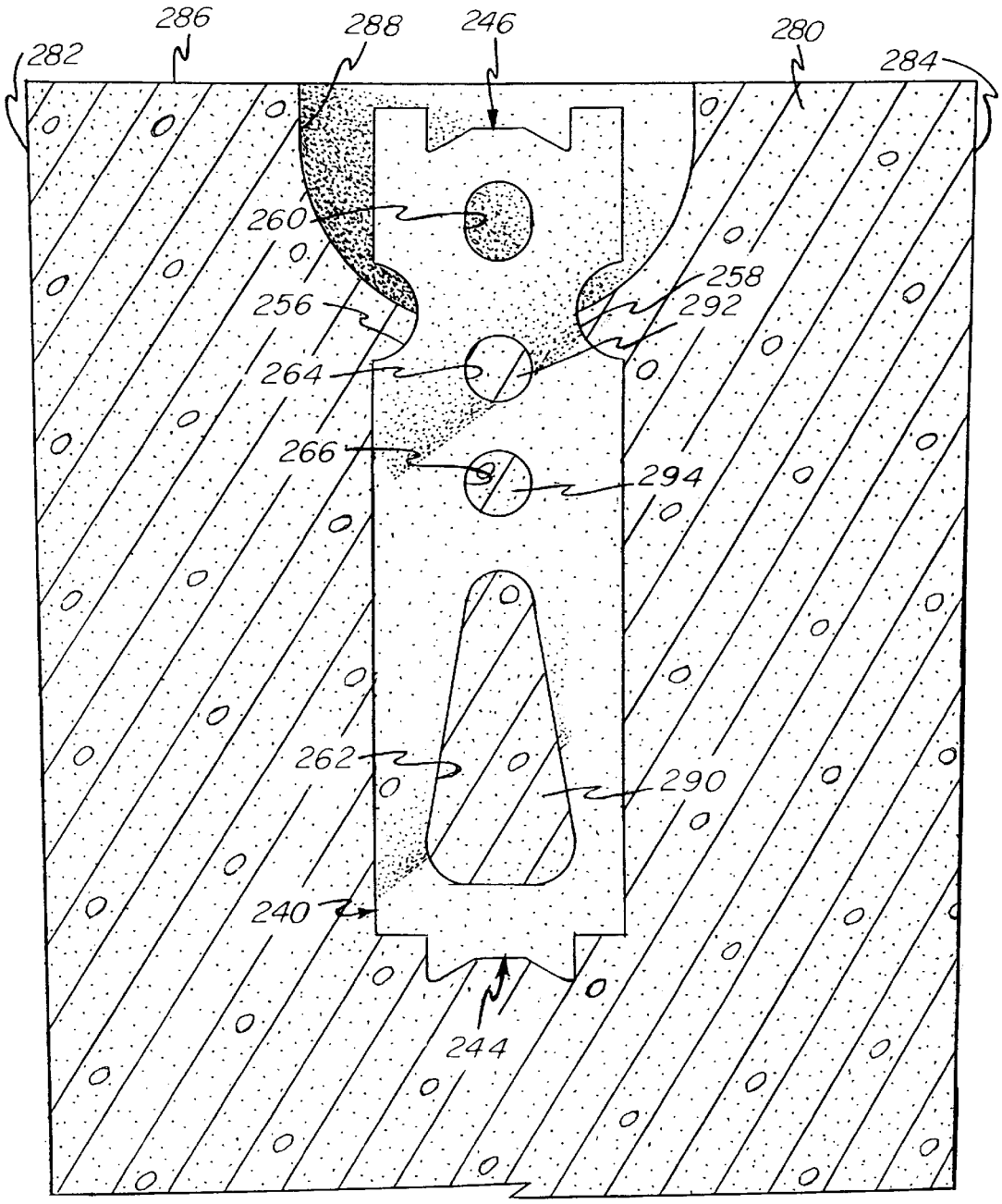
FIG. 23 is a partial sectional view of a concrete panel or the like with the concrete anchor of FIG. 21 embedded therein.

As shown in FIG. 23, the concrete anchor 240 preferably is combined with a concrete panel 280 which defines parallel first and second major planar surfaces 282 and 284; a relatively narrow edge 286; and a recess 288 extending through the relatively narrow edge 286 into the concrete panel 280. The inner end 244 of the concrete anchor 240 preferably is embedded in the concrete panel 280 such that a surface of the recess 288 intersects the pair of semi-circular recesses 256, 258. The outer end 246 of the concrete anchor 240 extends into the recess 288. The concrete anchor 240 most preferably is embedded in the concrete panel 280 by casting the concrete panel 280 around the concrete anchor 240, thereby forming "nuggets" 290, 292 and 294 through the void 262 and through the holes, 264, 266, respectively.

The structure of the concrete anchor 240 is designed to interact with the material of the concrete panel 280 to secure the concrete anchor 240 in the concrete panel 280. A pulling force applied to the outer end 246 of the concrete anchor 240 would react against the material of the concrete panel 210 in and immediately surrounding the pair of semi-circular recesses 256, 258. In addition, the nuggets 290, 292, 294 act as detents to directly resist the pulling force applied to the outer end 156.

The preferred concrete anchors 10 (FIGS. 1–5), 60 (FIGS. 7–8), 80 (FIGS. 9–10), 100 (FIGS. 11–12), 120 (FIGS. 13–14), 150 (FIGS. 15–19) and 240 (FIGS. 21–22) are each preferably formed as unitary stampings. Stamping provides a relatively simple process for manufacturing the concrete anchor (10 in FIGS. 1–5; 60 in FIGS. 7–8; 80 in FIGS. 9–10; 100 in FIGS. 11–12; 120 in FIGS. 13–14; 150 in FIGS. 15–19; and 240 in FIGS. 21–22). In addition, the preferred concrete anchor (10 in FIGS. 1–5; 60 in FIGS. 7–8; 80 in FIGS. 9–10; 100 in FIGS. 11–12; 120 in FIGS. 13–14; 150 in FIGS. 15–19; and 240 in FIGS. 21–22) is formed as a unitary member, without seams or weld lines which differ in strength from the surrounding metal.

Various changes or modifications in the invention described may occur to those skilled in the art without departing from the true spirit or scope of the invention. The above description of preferred embodiments of the invention is intended to be illustrative and not limiting, and it is not intended that the invention be restricted thereto but that it be limited only by the true spirit and scope of the appended claims.

We claim:

1. In combination with a concrete panel having major planar surfaces, a relatively narrow edge extending between said surfaces and means defining a recess in said edge extending inwardly therefrom intermediate said surfaces, and a concrete anchor including an elongated bar embedded in said panel and including substantially flat parallel faces, an inner end disposed within said panel, an outer end disposed within said recess and side edges extending between said faces, the improvement comprising:

said side edges extend in continuously diverging relationship from adjacent said outer end to adjacent said inner end.

2. The combination as recited in claim 1 wherein said side edges are substantially straight.

3. The combination as recited in claim 1 further comprising:

means defining an elongated opening in said outer end; and means defining a void occupying a major portion of said inner end.

4. The combination as recited in claim 1 further comprising:

means defining an elongated opening in said outer end; and means defining a void occupying a major portion of said inner end, said void being triangular in shape.

5. The combination as recited in claim 1 further comprising:

means defining recesses extending inwardly toward each other from said side edges adjacent said outer end; and means defining an elongated opening through said bar intermediate said recesses and said outer end.

6. The combination as recited in claim 1 further comprising:

means defining recesses extending inwardly towardly each other from said side edges adjacent said outer end; and means defining an elongated opening through said bar intermediate said recesses and said outer end.

7. In combination with a concrete panel having major planar surfaces, a relatively narrow edge extending between said surfaces and means defining a recess in said edge extending inwardly therefrom intermediate said surfaces, and a concrete anchor including an elongated bar embedded in said panel and including substantially flat parallel faces, an inner end disposed within said panel, an outer end disposed within said recess and side edges extending between said faces, the improvement comprising:

said outer end includes spaced, outwardly-projecting extensions disposed adjacent side edges of said bar;

said side edges extending longitudinally of said bar in spaced parallel relationship from adjacent said outer end to adjacent said inner end;

said inner end being complementary in shape to said outer end; and a major portion of said inner end being occupied by means defining a void therethrough.

8. The combination as recited in claim 7 wherein said side edges are substantially straight.

9. The combination as recited in claim 7 further comprising:

means defining an elongated opening in said outer end; and means defining a void occupying a major portion of said inner end.

10. The combination as recited in claim 7 further comprising:

means defining an elongated opening in said outer end; and means defining a void occupying a major portion of said inner end, said void being triangular in shape.

11. An concrete anchor embedded in a concrete panel comprising:

an elongated metal bar defining an inner end, an outer end, a first planar face extending from said outer end to said inner end, and a second planar face extending parallel to said first planar face from said outer end to said inner end;

an eye extending between said first and second planar faces near said outer end; and a void extending between said first and second planar faces near said inner end, said void defining opposed wall portions converging from said inner end toward said outer end.

12. The concrete anchor as recited in claim 11 wherein said elongated metal bar defines sides extending between said first and second planar faces, said sides extending in continuously diverging relationship from adjacent said outer end to adjacent said inner end.

13. The concrete anchor as recited in claim 11 wherein said elongated metal bar defines recesses having sections extending in continuously diverging relationship in a direction parallel to that extending from adjacent said outer end to adjacent said inner end.

14. The concrete anchor as recited in claim 11 further including at least one hole therethrough.

15. The concrete anchor as recited in claim 11 wherein said outer end includes a pair of extensions and wherein said outer end is recessed in a space between said extensions.

16. An concrete anchor embedded in a concrete panel comprising:

an elongated metal bar defining an inner end, an outer end, a first planar face extending from said outer end to said inner end, a second planar face extending parallel to said first planar face from said outer end to said inner end, a first side edge extending between said first and second planar faces, and a second side edge extending between said first and second planar faces, said first and second side edges extending in continuously diverging relationship from adjacent said outer end to adjacent said inner end.

17. A concrete anchor as recited in claim 16 including:

an eye extending between said first and second planar faces near said outer end; and a void extending between said first and second planar faces near said inner end, said void defining opposed wall portions converging from said inner end toward said outer end.

18. A concrete anchor as recited in claim 16 wherein said first and second side edges diverge at an included angle of approximately 3°–15° with respect to one another.

* * * * *